US007621137B2

(12) United States Patent
Aflekt et al.

(10) Patent No.: US 7,621,137 B2
(45) Date of Patent: Nov. 24, 2009

(54) METHOD OF OPERATION AND REGULATION OF A VAPOUR COMPRESSION SYSTEM

(75) Inventors: Kåre Aflekt, Trondheim (NO); Armin Hafner, Trondheim (NO); Arne Jakobsen, Trondheim (NO); Petter Nekså, Trondheim (NO); Jostein Pettersen, Trondheim (NO); Håvard Rekstad, Trondheim (NO); Geir Skaugen, Trondheim (NO); Trond Andresen, Trondheim (NO); Espen Tøndell, Trondheim (NO); Munan Elgsæther, Trondheim (NO)

(73) Assignee: Sinvent AS, Trondheim (NO)

( * ) Notice: Subject to any disclaimer, the term of this patent is extended or adjusted under 35 U.S.C. 154(b) by 514 days.

(21) Appl. No.: 10/539,611

(22) PCT Filed: Dec. 17, 2003

(86) PCT No.: PCT/NO03/00425

§ 371 (c)(1),
(2), (4) Date: Nov. 7, 2005

(87) PCT Pub. No.: WO2004/057246

PCT Pub. Date: Jul. 8, 2004

(65) Prior Publication Data

US 2006/0150646 A1 Jul. 13, 2006

(30) Foreign Application Priority Data

Dec. 23, 2002 (NO) ..... 20026232

(51) Int. Cl.
*F25B 49/00* (2006.01)

(52) U.S. Cl. ..... 62/126; 62/228.3

(58) Field of Classification Search ..... 62/114, 62/126, 157, 228.3
See application file for complete search history.

(56) References Cited

U.S. PATENT DOCUMENTS

| | | | | |
|---|---|---|---|---|
| 5,685,160 | A | 11/1997 | Abersfelder et al. | |
| 6,606,867 | B1 * | 8/2003 | Sienel | 62/113 |
| 6,701,725 | B2 * | 3/2004 | Rossi et al. | 62/125 |

FOREIGN PATENT DOCUMENTS

| | | |
|---|---|---|
| DE | 10053203 | 6/2001 |
| EP | 1202004 | 5/2002 |
| JP | 2001-289537 | 10/2001 |

* cited by examiner

*Primary Examiner*—Marc E Norman
(74) *Attorney, Agent, or Firm*—Wenderoth, Lind & Ponack, L.L.P.

(57) ABSTRACT

The present invention involves a compression refrigeration system including a compressor, a heat rejector, expansion means and a heat absorber connected in a closed circulation circuit that may operate with supercritical high-side pressure. An apparatus and method are provided to optimize energy efficiency.

20 Claims, 2 Drawing Sheets

METHOD OF OPERATION AND REGULATION OF A VAPOUR COMPRESSION SYSTEM

BACKGROUND OF THE INVENTION

1. Field of Invention

The present invention relates to a compression refrigeration system including a compressor, a heat rejector, an expansion means and a heat absorber connected in a closed circulation circuit that may operate with supercritical high-side pressure, using carbon dioxide or a mixture containing carbon dioxide as the refrigerant in the system.

2. Description of Related Art

Conventional vapour compression systems reject heat by condensation of the refrigerant at subcritical pressure given by the saturation pressure at the given temperature. When using a refrigerant with low critical temperature, for instance $CO_2$, the pressure at heat rejection will be supercritical if the temperature of the heat sink is high, for instance higher than the critical temperature of the refrigerant, in order to obtain efficient operation of the system. The cycle of operation will then be transcritical, for instance as described in WO 90/07683. Temperature and high-side pressure will be independent variables, contrary to conventional systems.

WO 94/14016 and WO 97/27437 both describe a simple circuit for realising such a system, comprising a compressor, a heat rejector, an expansion means and an evaporator connected in a closed circuit. $CO_2$ is the preferred refrigerant for both systems.

The system coefficient of performance (COP) for transcritical vapour compression systems is strongly affected by the level of the high side pressure. This is thoroughly explained by Pettersen & Skaugen (1994), which also presents a mathematical expression for the optimum pressure. Because high side pressure is not a function of temperature, high side pressure can be controlled in order to achieve optimum energy efficiency. To do so it is necessary to determine optimum pressure for given operating conditions.

Several publications and patents are published which suggest different strategies to determine the optimum high side pressure. Inokuty (1922) published a graphic method already in 1922, but it is not applicable for the present digital controllers.

EP 0 604 417 B1 describe how different signals can be used as steering parameter for the high side pressure. A suitable signal is the heat rejector refrigerant outlet temperature. The correlation between optimum high side pressure and the signal temperature is calculated in advance or measured. Densopatent describes more or less an analogous strategy. Different signals are used as input parameters to a controller, which based on the signals regulates the pressure to a predetermined level.

Among others, Liao & Jakobsen (1998) presented an equation which calculates optimum pressure from theoretical input. The equation does not take into account practical aspects which may affect the optimum pressure significantly.

Most methods for optimum pressure determination described above take a theoretical approach. This means that they are not able to compensate for practical aspects like varying operating conditions, and the influence of oil in the system. Optimum pressure is thus frequently different from the calculated one. There is also a risk for a "wind up" and lack of control. This happens when a temperature signal gives a feedback to the controller, which adjust the pressure with some delay. If conditions change rapidly, the controller will never establish a constant pressure, and cooling capacity will vary.

As explained above, it is a possibility to run tests and measure optimum high side pressure relations. But this is time consuming and expensive. Furthermore, it is hard, if not impossible, to cover all operating conditions, and the measurements have to be performed for all new designs.

BRIEF SUMMARY OF THE INVENTION

A major object of the present invention is to make a simple, efficient system that avoids the aforementioned shortcomings and disadvantages.

The invention is characterized by the features as defined in the accompanying claims. Advantageous features of the invention are also defined therein.

The present invention is a new and novel method for optimum operation of a system with respect to energy efficiency, the system comprising at least a compressor, heat rejector, expansion means, and a heat absorber.

When operating conditions change, the controller in the transcritical vapour compression system can perform a perturbation of the high side pressure and thereby establish a correlation between the pressure and the energy efficiency, or a suitable parameter reflecting the energy efficiency. A correlation between high side pressure and energy efficiency can then easily be mapped, and optimum pressure determined and used until operating conditions change. This is a method which will work for all designs of transcritical vapour compression systems. No initial measurements have to be made, and practical aspects will be accounted for on site.

BRIEF DESCRIPTION OF THE DRAWINGS

The invention will be further described in the following by way of examples only and with reference to the drawings in which.

DETAILED DESCRIPTION OF THE INVENTION

Figure 1:
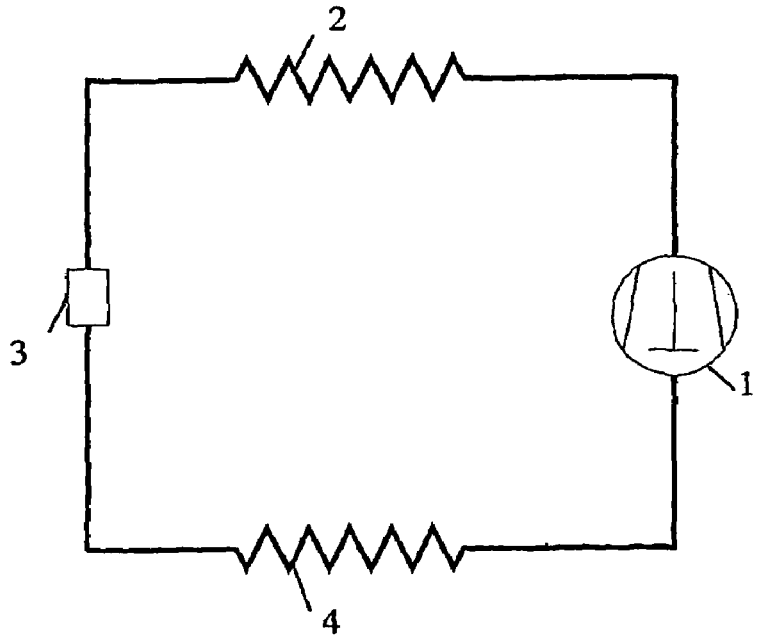
FIG. 1 illustrates a simple circuit for a vapour compression system.

FIG. 1 illustrates a conventional vapour compression system comprising a compressor 1, a heat rejector 2, an expansion means 3 and a heat absorber 4 connected in a closed circulation system.

Figure 2:
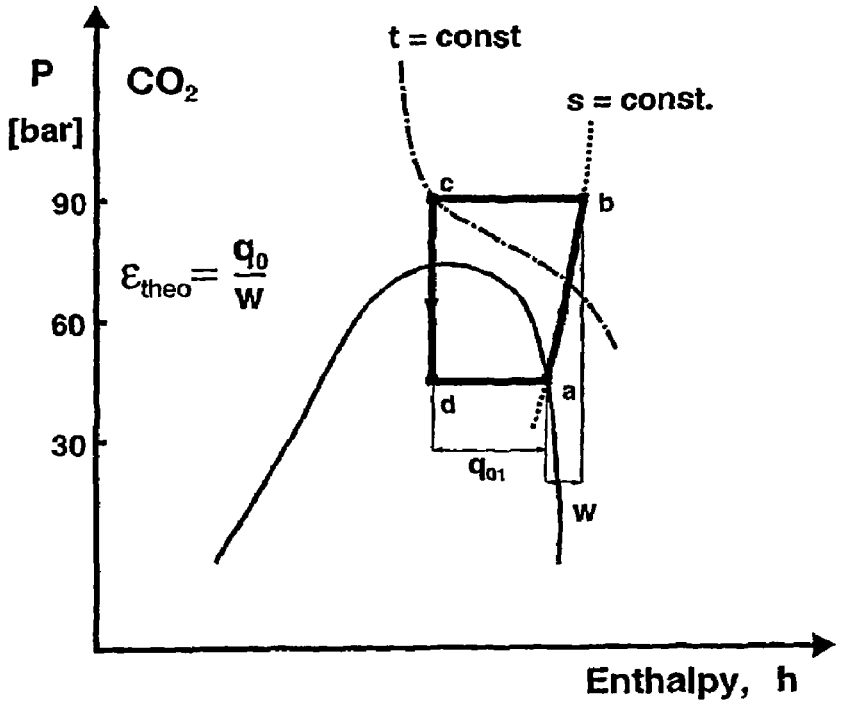
FIG. 2 shows a temperature entropy diagram for carbon dioxide with an example of a typical trans-critical cycle.

FIG. 2 shows a transcritical $CO_2$ cycle in a temperature entropy diagram. The compression process is indicated as isentropic from state a to b. The refrigerant exit temperature out of the heat rejector c is regarded as constant. Specific work, specific cooling capacity and coefficient of performance are explained in the figure.

As mentioned above, there is a mathematical expression for high optimum high side pressure in a trans-critical vapour compression system. The expression is as follows:

$$\left(\frac{\partial h_c}{\partial p}\right)_T = -\varepsilon\left(\frac{\partial h_b}{\partial p}\right)_s$$

The optimum pressure is achieved when the marginal increase of capacity (change of $h_c$ at constant temperature) equals $\epsilon$ times the marginal increase in work (change of $h_b$ at constant entropy).

Perturbation of the high side pressure, is in principle a practical approach to use the equation above. By mapping the energy efficiency, or a parameter which reflects the energy efficiency, as function of high side pressure, it is possible to establish the point where the marginal increase of capacity equals $\epsilon$ times the marginal increase in work.

Various parameters can be used as reflection for the energy efficiency.

EXAMPLE 1

The temperature difference between refrigerant and heat sink at the cold end of the heat rejector 4, is often denoted as "temperature approach" for a transcritical cycle. There is a correlation between high side pressure and the temperature approach. An increase of the high side pressure will lead to a reduction of temperature approach. The high side pressure can favourably be increased until a further increase does not lead to a significant reduction of temperature approach. At this point, optimum high side pressure is established, and the system can be operated at optimum conditions, maximizing the system COP. This principle is illustrated in FIG. 3.

Figure 3:
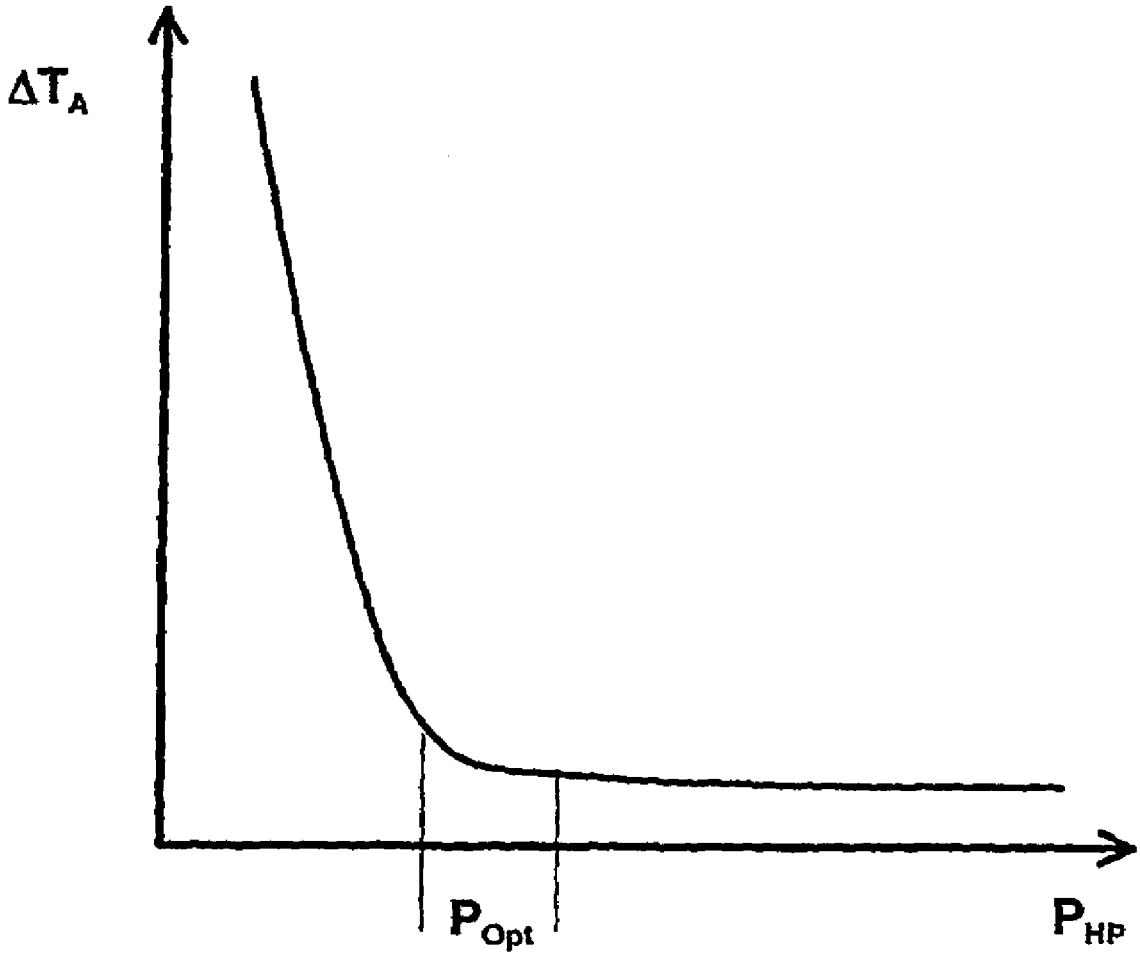
FIG. 3 shows a schematic diagram showing the principle of optimum high side pressure determination. Temperature approach is used as COP reflecting parameter in the figure.

A perturbation of the high side pressure will produce a relation as indicated in FIG. 3. When operating conditions change, or for other reasons, a new perturbation can be made and a new updated relation established. In this way, the transcritical system will always be able to operate close to optimum conditions.

EXAMPLE 2

Instead of using the temperature approach, it is an option to use the gas cooler outlet temperature as parameter for reflection of energy efficiency.

EXAMPLE 3

By measurements of system pressures and temperatures, it is possible to automatically calculate the enthalpies for a transcritical cycle at the points 1 to 4 indicated in FIG. 2, if the refrigerant properties are known. The enthalpies can be used for calculation of the system coefficient of performance. A perturbation of the high side pressure will then produce a relation between COP and the high side pressure directly.

If COP is used as steering parameter, the optimum high side pressure will be established directly. If a COP reflecting parameter is used, an exact measure for the "marginal effect" on the parameter has to be quantified. This measure can however easily be estimated. Another possibility is to increase pressure until the parameter reaches a predetermined level.

The invention claimed is:

1. A compression refrigeration system comprising:

a closed circulation circuit comprising a compressor, a heat rejector, an expansion device, and a heat absorber, said closed circulation circuit being operable to circulate a refrigerant and pressurize the refrigerant to a high-side pressure, the high-side pressure being supercritical; and a controller operable to estimate a parameter value reflecting energy consumption to determine an optimum high-side pressure by perturbation of the high-side pressure during operation of said compression refrigeration system;

wherein said compression refrigeration system operates at the optimum high-side pressure after the optimum high-side pressure has been determined.

2. The compression refrigeration system of claim 1, wherein said closed circulation circuit includes the refrigerant, and said refrigerant comprises carbon dioxide.

3. The compression refrigeration system of claim 1, wherein the parameter value reflects minimum operable energy consumption.

4. The compression refrigeration system of claim 1, wherein said heat rejector lowers a temperature of the refrigerant, said heat rejector utilizing a heat sink; and wherein the parameter value is a difference in temperature between the refrigerant and the heat sink.

5. The compression refrigeration system of claim 1, wherein said heat rejector lowers a temperature of the refrigerant, said heat rejector utilizing a heat sink; and wherein said controller estimates the parameter value by increasing the high-side pressure, monitoring an impact of increasing the high-side pressure on a difference in temperature between the refrigerant and the heat sink, and discontinuing increasing the high-side pressure when the impact is below a threshold level.

6. The compression refrigeration system of claim 5, wherein the threshold level varies according to at least one operating condition.

7. The compression refrigeration system of claim 1, wherein the parameter value is an outlet temperature of said heat rejector.

8. The compression refrigeration system of claim 1, wherein said controller estimates the parameter value by varying the high-side pressure and determining the optimum high-side pressure corresponding to a minimum operable energy consumption of the compression refrigeration system.

9. The compression refrigeration system of claim 1, wherein said compressor pressurizes the refrigerant to the optimum high-side pressure after the optimum high-side pressure has been determined.

10. The compression refrigeration system of claim 1, wherein said controller controls a perturbation of the high-side pressure and establishes a correlation between the high-side pressure and the parameter value, the parameter value reflecting a minimum operable energy consumption.

11. A method of operating a compression refrigeration system including a closed circulation circuit comprising a compressor, a heat rejector, an expansion device, and a heat absorber, the method comprising:

operating the compression refrigeration system by circulating a refrigerant through the closed circulation circuit and pressurizing the refrigerant to a high-side pressure, the high-side pressure being supercritical;

estimating a parameter value reflecting energy consumption to determine an optimum high-side pressure by perturbation of the high-side pressure during operation of the compression refrigeration system; and operating the compression refrigeration system at the optimum high-side pressure after the optimum high-side pressure has been determined.

12. The method of claim 11, wherein the refrigerant comprises carbon dioxide.

13. The method of claim 11, wherein said estimating of the parameter value comprises:

providing a controller which controls a perturbation of the high-side pressure and estimates the parameter value, the parameter value reflecting minimum operable energy consumption.

14. The method of claim 11, wherein said operating of the compression refrigeration system comprises the heat rejector lowering the temperature of the refrigerant, the heat rejector utilizing a heat sink; and wherein the parameter value is a difference in temperature between the refrigerant and the heat sink.

15. The method of claim 11, wherein said operating of the compression refrigeration system comprises the heat rejector lowering the temperature of the refrigerant, the heat rejector utilizing a heat sink; and wherein said estimating of the parameter value comprises:

increasing the high-side pressure, monitoring an impact of increasing the high-side pressure on a difference in temperature between the refrigerant and the heat sink, discontinuing increasing the high-side pressure when the impact is below a threshold level.

16. The method of claim 15, wherein the threshold level varies according to at least one operating condition.

17. The method of claim 11, wherein the parameter value is an outlet temperature of the heat rejector.

18. The method of claim 11, wherein said estimating of the parameter value comprises:

varying the high-side pressure;

determining a high-side pressure corresponding to a minimum operable energy consumption of the compression refrigeration system.

19. The method of claim 11, wherein said operating of the compression refrigeration system after the optimum high-side pressure has been determined comprises pressurizing the refrigerant to the optimum high-side pressure.

20. The method of claim 11, wherein said estimating of the parameter value comprises:

providing a controller which controls a perturbation of the high-side pressure and establishes a correlation between high-side pressure and the parameter value, the parameter value reflecting a minimum operable energy consumption.

* * * * *